United States Patent [19]

Switzer

[11] 4,160,509

[45] Jul. 10, 1979

[54] FREIGHT CAR DOOR OPENER

[76] Inventor: Ralph V. Switzer, 3410 Sunset, Waukegan, Ill. 60085

[21] Appl. No.: 866,532

[22] Filed: Jan. 3, 1978

[51] Int. Cl.[2] ..... B66F 9/19

[52] U.S. Cl. ..... 414/607; 105/378; 414/373

[58] Field of Search ..... 214/44 R, 152, 620; 105/378; 212/4

[56] References Cited

U.S. PATENT DOCUMENTS

| | | | |
|---|---|---|---|
| 1,690,262 | 11/1928 | Westling | 214/44 R X |
| 2,558,388 | 6/1951 | Richardson | 214/620 |
| 2,802,583 | 8/1957 | Dansereau | 214/38 C X |
| 3,984,020 | 10/1976 | Fuller et al. | 214/620 |

FOREIGN PATENT DOCUMENTS

| | | | |
|---|---|---|---|
| 2361205 | 6/1975 | Fed. Rep. of Germany | 214/620 |
| 163642 | 7/1964 | U.S.S.R. | 214/44 |

*Primary Examiner*—Frank E. Werner

[57] ABSTRACT

A removable attachment for a powered industrial truck, such as a fork lift, used to open and close freight car doors and the like.

4 Claims, 3 Drawing Figures

FREIGHT CAR DOOR OPENER

SUMMARY OF THE INVENTION

The use of industrial power equipment, such as fork lift trucks, for opening and closing slidable doors of freight car containers, such as railroad box cars, has become so uniform and the resulting danger and damage to both equipment and personnel so immediate, that such practices were declared in violation of a government directive promulgated by the Occupational Safety and Health Administration.

The use of industrial power equipment for opening and closing railroad freight car doors has now been recognized by OSHA only when the equipment is supplied with a device that supplies force to the door in a direction parallel to the door travel.

It is the purpose of this invention to provide a specifically designed device whereby door opening and closing forces are applied through the power equipment in a line parallel to the door travel.

The device of this invention is readily mountable upon a fork lift truck and provides connecting means for attachment to the door of a freight car whereby the same may be opened or closed.

DESCRIPTION OF THE DRAWINGS

The invention will be best understood by reference to the accompanying drawings showing the preferred form of invention by which the objects are achieved, and in which.

GENERAL DESCRIPTION

Figure 1:
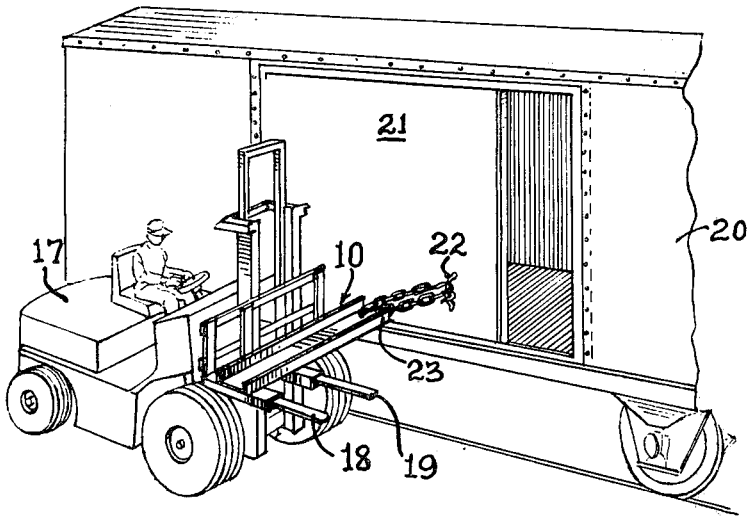
FIG. 1 is a perspective view of the invention in an operative position.

The car door opener consists of a framelike body 10 which provides a pair of parallely extending tubular structure members 11 and 12 as well as a transversely extending beam 13 which is of a length to extend beyond either of said parallel tubular members 11 and 12. By a looped pin 14 there is provided a swivel connection for a chain 15, the free ends of which are provided with hooklike elements 16.

The device described is adapted to be removably mounted upon power equipment, such as a fork life truck 17, with the fork lift truck providing a pair of normally spaced apart parallelly extending fork prongs 18 and 19. The tubular members 11 and 12 provide open sleeves for the reception of the prongs 18 and 19 so as to removably connect the body 10 to the fork lift truck, as shown in FIG. 1.

A freight car 20 normally provides a slidable door 21, which is equipped with suitable handles or the like 22.

When the body 10 of this invention is in use, it will be movably connected to the fork lift truck 17 which has positioned itself parallel to the side of the freight car 20 as well as parallel to the longitudinal slidably movement of the door 21. The hook elements 16 are engaged with the handles 22, and therefore any parallel movement of the fork lift truck 17 relative to the side of the freight car 20 will result in the application of movable force to the door 21 in a direction parallel to its travel.

Figure 2:
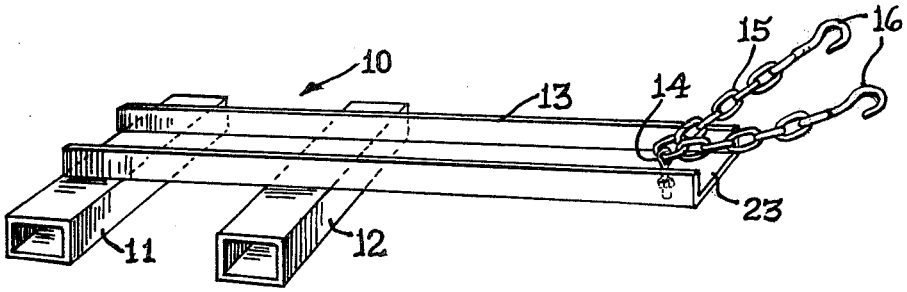
FIG. 2 is a perspective view of the car door opener of this invention.

It should be noted that the beam 13, as viewed in FIGS. 1 and 2, extends to one side of the tubular members 11 and 12 a distance sufficient to be projected beyond the side of the fork lift truck 17 so that the free end 23 of such beam 13 may be disposed as close as possible to the side wall of the freight car 20. This also permits the projected free end 23 of the beam 13 to engage the edge of the car door and push directly against the same, if for some reason the chains cannot be used.

Figure 3:
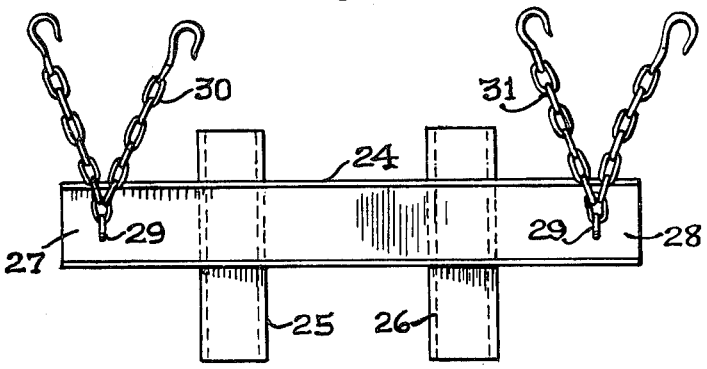
FIG. 3 is a view of a modified form of the car door opener.

In FIG. 3 is illustrated a modification of the invention, in that the beam 24 of such modification extends to either side of the tubular members 25 and 26 and has adjacent the opposite free ends 27 and 28 thereof an attachment 29 for the chains 30 and 31.

From the foregoing, it is apparent that I have provided a detachable attachment for use with a fork lift truck that is utilized for opening and closing freight car doors by imposing upon such doors a moving force parallel to the direction of travel of such door when it is moved into open or closed condition. The attachment may be readily removed from the power equipment, such as the fork lift truck, permitting the latter to be normally used.

While I have illustrated and described the preferred from of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A freight car door opener for attachmemt to a powered industrial fork lift truck and the like providing a pair of elongated forwardly projecting prongs comprising (a) a framelike body having a pair of elongated members extending in spaced relation to each other, (b) a beam carried by said members and extending transversely thereto and of a length to project beyond the side of the fork lift truck, (c) said members providing sleeves extending longitudinally therethrough and adapted to receive therein the prongs of the fork lift truck so as to attach the framelike body thereto for movement therewith, (d) a chain connected to the end of said beam extending beyond the side of said members, and (e) means on the end of said chain for connection to a freight car door for exerting movable force thereto parallel to the travel of the door as said fork lift truck is moved in one direction.

2. A freight car door opener as defined by claim 1, wherein said means on the end of said chain for connection to a freight car door, comprise hook elements.

3. A freight car door opener as defined by claim 1, wherein said beam is of a length to extend beyond the opposite sides of the fork lift truck and further defined as having a second chain connected to the other end of said beam.

4. A freight car door opener as defined by claim 3, wherein said means on the end of said chain for connection to a freight car door, comprise hook elements.

* * * * *